US005357322A

United States Patent [19]

Hoshika

[11] Patent Number: 5,357,322

[45] Date of Patent: Oct. 18, 1994

[54] CHARGER

[75] Inventor: Norihisa Hoshika, Kawasaki, Japan

[73] Assignee: Canon Kabushiki Kaisha, Tokyo, Japan

[21] Appl. No.: 996,871

[22] Filed: Dec. 28, 1992

Related U.S. Application Data

[63] Continuation of Ser. No. 645,451, Jan. 24, 1991, abandoned.

[30] Foreign Application Priority Data

Jan. 24, 1990 [JP] Japan ..... 2-14092
Jan. 24, 1990 [JP] Japan ..... 2-14093

[51] Int. Cl.[5] ..... G03G 15/02

[52] U.S. Cl. ..... 355/219; 250/325; 361/221; 361/225

[58] Field of Search ..... 355/219; 361/220, 221, 361/222, 225, 235; 250/324, 325, 326

[56] References Cited

U.S. PATENT DOCUMENTS

| | | | |
|---|---|---|---|
| 3,671,806 | 6/1972 | Whitmore et al. | 317/2 |
| 4,259,003 | 3/1981 | Mangal et al. | 361/220 X |
| 4,727,453 | 2/1988 | Ewing | 361/225 |
| 5,008,706 | 4/1991 | Ohmori et al. | 355/219 |
| 5,043,579 | 9/1991 | Gundlach et al. | 250/325 |

FOREIGN PATENT DOCUMENTS

| | | |
|---|---|---|
| 0035745 | 9/1981 | European Pat. Off. . |
| 0308185 | 3/1989 | European Pat. Off. . |
| 0312230 | 4/1989 | European Pat. Off. . |
| 0329366 | 8/1989 | European Pat. Off. . |
| 57-201275 | 12/1982 | Japan . |
| 60-14966 | 1/1985 | Japan . |
| 0113083 | 5/1986 | Japan . |
| 0118776 | 6/1986 | Japan . |
| 0175781 | 8/1987 | Japan . |
| 0048754 | 3/1988 | Japan . |
| 63-93760 | 4/1988 | Japan . |

OTHER PUBLICATIONS

"Physics Of Semiconductor Devices", Second Edition, S. M. Sze, 1981, pp. 30–32.

"Cours d'electricite", A. Fruling, vol. 1, 1966, p. 212. (No English language translation).

*Primary Examiner*—Michael L. Gellner
*Assistant Examiner*—P. Stanzione
*Attorney, Agent, or Firm*—Fitzpatrick, Cella, Harper & Scinto

[57] ABSTRACT

A charging device for charging a moving member to be charged includes a charging member for contact with the member to be charged to which a voltage is applied; wherein the charging member has a volume resistivity of not more than $1\times10^9$ ohm.cm, and a surface resistivity at a surface contactable to the member to be charged not less than $5\times10$ ohm/□.

36 Claims, 6 Drawing Sheets

CHARGER

This application is a continuation of application Ser. No. 07/645,451 filed Jan. 24, 1991, now abandoned.

FIELD OF THE INVENTION AND RELATED ART

The present invention relates to a charger for charging a moving photosensitive member as in an electrophotographic copying machine or laser beam printer by contacting a charging member supplied with an external voltage.

As for the means for uniformly charging a surface of an image bearing member such as a photosensitive member or a dielectric member (a member to be charged) in an image forming apparatus such as a copying machine or a recording apparatus, a corotron or scorotron capable of providing a uniform charge or other corona dischargers are widely used.

However, a corona discharger involves various problems. It requires a high voltage source which is expensive. It requires a larger space by itself and a further space for the shielding space for the high voltage source. It produces a relatively large amount of ozone or corona production. To avoid the problems therefrom, it requires additional means and mechanisms with the result of bulky apparatus and high cost.

Recently, therefore, contact type charging is considered in place of the corona discharger.

The contact type charging is such that a conductive member (contact type charging member) is supplied with a voltage from a voltage source (for example a DC voltage of 1–2 KV approximately or a DC biased AC voltage) and is contacted to the image bearing member (a member to be charged) so as to charge the surface of the image bearing member to a predetermined level. It is in the form of a roller type (Japanese Laid-Open Patent Application No. 91253/1981), in the form of a blade (Japanese Laid-Open Patent Applications Nos. 194349/1981 and 147756/1985), in the form of a charging-cleaning type (Japanese Laid-Open Patent Application No. 165166/1981), or the like. However, the contact type charging system involves a problem that when the image bearing member such as a photosensitive member has a pin hole (surface defect of the member to be charged), a spark discharge easily occurs between the contact charging members supplied with a voltage and contacted to the image bearing member and the pin hole of the image bearing member. If the discharge occurs, the electric charge is not applied over the entire contact area between the charging member and the photosensitive member, including the pin hole position (local charge void).

In order to avoid this problem, Japanese Laid-Open Patent Application No. 93760/1988 which has been assigned to the assignee of this application, has proposed that the conductive base in the form of a blade is used as a contact charging member is coated with a resistance layer of one or more materials having an electric resistance which is higher than the conductive base, at the portions thereof electrostatically influential in relation to the image bearing member.

The charging blade having the surface electric resistance layer is effective. However, it involves the problem in the manufacturing since it involves a larger number of manufacturing steps. In addition, higher manufacturing accuracy is required. As a result, the cost of the charging 5lade is increased.

In the case of the charging member in the form of a blade, the spark discharge resulting from the pin hole of the member to be charged occurs at two positions in the regions away from the contact line between the member to be charged 1 and the end edge of the charging blade 30, as shown in FIG. 7. In this Figure, references P and S respectively designate a pin hole of the member to be charged 1 and the spark discharge.

Therefore, when the charging member is in the form of a blade, the resistance layer has to be applied to the two surfaces, namely, contacting surface and the end surface. If an attempt is made to apply the resistance layer to the end surface and the edge portion, the thickness of the coating layer of the resistance material at the edge becomes small. In order to assure the minimum required thickness at the edge, the entire coating thickness has to be increased with the result of increasing the number of coating steps and in addition the poorer charging property with the increase of the thickness of the resistance layer.

If a resistance sheet (solid) having a thickness not more than 100 microns is bonded to the conductive base layer, it is difficult practically in the manufacturing to bond it to the edge with high accuracy. It would be required to fill the clearance between the resistance layer and the corner of the edge. This requires additional manufacturing difficulty.

FIG. 8 shows the case wherein the resistance layer is not provided at the end surface of the charging blade 30. In this case, the edge end surface of the conductive base 31 of the charging blade is rounded, as indicated by a reference d, and the conductive base is not exposed at the edge surface d. In this Figure, reference numeral 32 designates a resistance layer.

However, in the case of such a charging blade, the rounding step is required, and the accuracy of bonding the resistance layer 32 is required. Additionally, since the thickness of the conductive base 31 of the blade is small at the contact area, the state of contact is not stabilized.

SUMMARY OF THE INVENTION

Accordingly, it is a principal object of the present invention to provide a charging member wherein the leak current from the charging means to the member to be charged is efficiently prevented.

It is another object of the present invention to provide a charging device wherein the member to be charged is uniformly charged without local charge void.

It is a further object of the present invention to provide a contact type charging device capable of effecting uniform charging.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1 (FIGS. 1-4)

Figure 1:
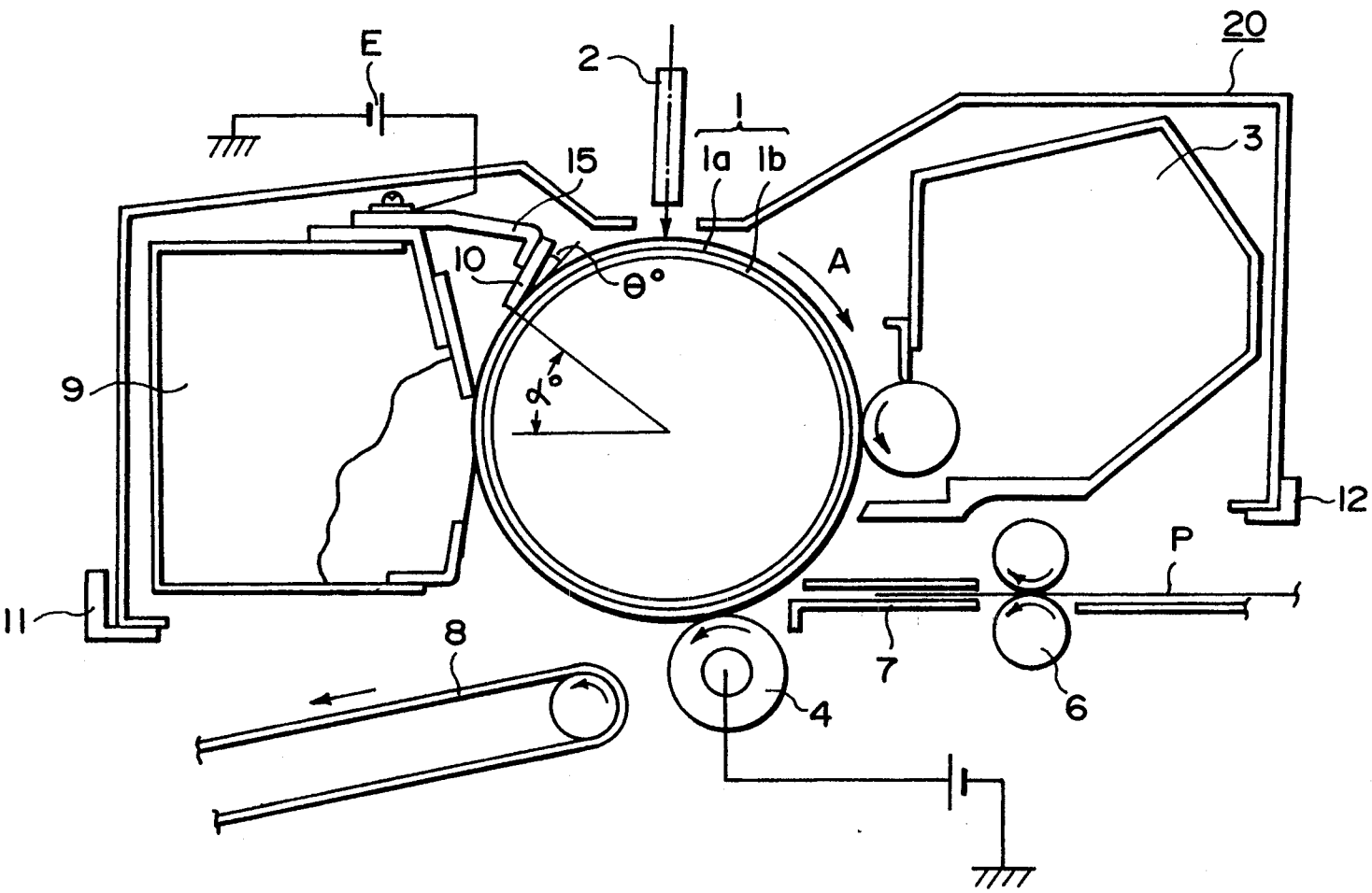
FIG. 1 is a sectional view of a major part of an image forming apparatus using a contact type charging device according to an embodiment of the present invention.

(1) Image Forming Apparatus (FIG. 1)

FIG. 1 shows a major part of an image forming apparatus using the contact type charger according to the present invention. It comprises an electrophotographic photosensitive member 1 (image bearing member) in the form of a rotatable drum. In this embodiment, it comprises a photosensitive layer 1*a* of OPC (organic photoconductor) having a thickness of 25 microns and a dielectric constant of approximately 3, and a conductive base 1*b* made of aluminum. It is rotated in the clockwise direction at a predetermined peripheral speed (process speed).

In this embodiment, the image bearing member 1 is in the form of a drum, but it may be a rotatable belt type. Whether it is in the form of a drum or belt, it may be a seamless, or it has a seam if a synchronizing signal is used.

The image forming apparatus further comprises an array 2 of short focus lenses as exposure means for forming a latent image on the photosensitive drum 1, a developing device 3, a transfer roller 4 (transfer means), timing rollers (registration rollers) for feeding a transfer material P supplied one by one from an unshown sheet supplying station to an image transfer station between the photosensitive drum 1 and the transfer roller 4 in timed relation with the rotation f the photosensitive drum 1, a transfer material guide 7 disposed between the timing roller 6 and the transfer roller 4 to guide the transfer material P, a conveying means 8 for conveying the transfer sheet P to an unshown fixing means after the transfer material P has been passed through the nip or clearance between the photosensitive drum 1 and the transfer roller 4 to receive the image, and a cleaning device for removing the residual toner or the like from the photosensitive drum 1 after the image is transferred. Designated by a reference numeral 10 is a charging blade in the form of a contact type charging member for contacting the photosensitive drum 1 after the cleaning, to uniformly charge it. The charging blade 10 will be described in detail hereinafter.

In this embodiment, the photosensitive drum 1, the charging blade 10, the developing device 3 and the cleaning device 4 (four process means) are contained in a process cartridge 20 as a unit with predetermined positional relations among them. The cartridge 20 is movable in the direction perpendicular to the sheet of the drawing along supporting rails 11 and 12 into the main assembly of the copying machine. Reversely, it may be retracted from the main assembly.

When the process cartridge 20 is sufficiently inserted into the main assembly o the copying apparatus, the main assembly and the process cartridge 20 are mechanically and electrically coupled to enable copying operation.

Figure 2:
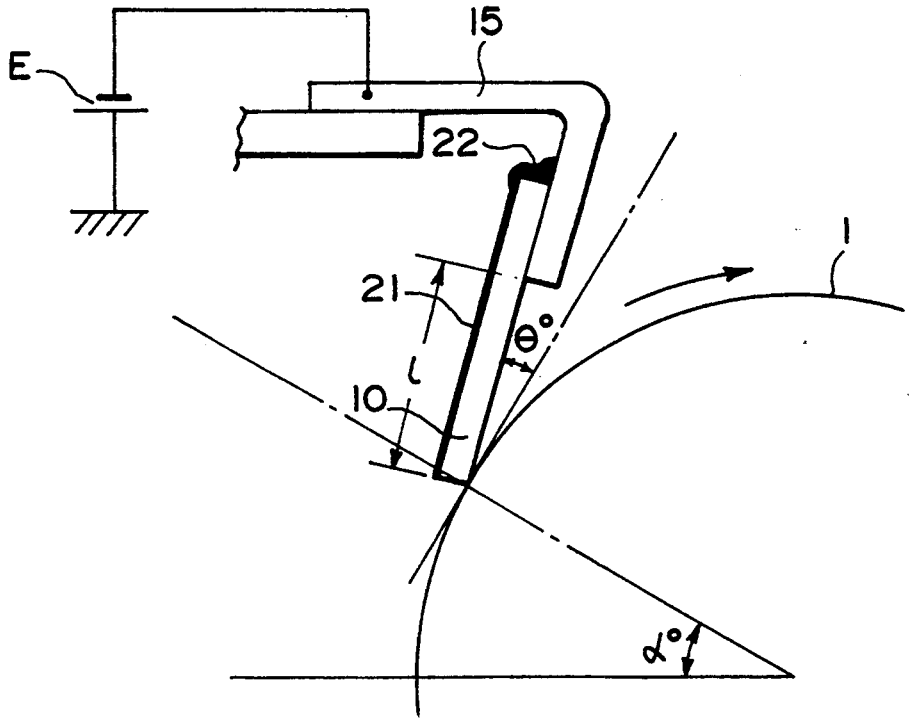
FIG. 2 is an enlarged view of a charging blade used in the apparatus of FIG. 1.

(2) Charging Blade 10 (FIG. 2)

FIG. 2 is an enlarged view of the charging blade 10 used in the apparatus of FIG. 1.

The charging blade 10 is fixed on the supporting metal plate 15. It is Contacted counter directionally (at acute contact angle) to the photosensitive drum 1 at a position of angle $\alpha$ degree from the horizontal line of the photosensitive drum 1 (the member to be charged) at a contact angle $\theta$ degree formed between a tangential line (plane). The contact angle is an angle formed with downstream one (downstream of the contact point with respect to the movement direction of the peripheral surface of the drum) of the tangential lines of the drum at the blade edge and the contact point.

The contact position $\alpha$ degree is properly selected in consideration of the positioning of various process means and the diameter of the photosensitive drum and the like.

The contact angle $\theta$ degree of the charging blade 10 is preferably not more than 30 degrees from the standpoint of stability of the charging action.

The contact is not limited to the counter directional, but may be codirectional (dull contact angle). However, the counter directional contact is preferable because the residual matter such as toner can be blocked, and therefore, the residual matter is prevented from reaching the charged surface (the surface portion downstream of the edge with respect to the peripheral movement direction of the drum). Then, the nonuniform charging does not occur easily.

To the backside of the charging blade 10, a back electrode 21 is electrically coupled to the charging blade. The voltage applied to the charging blade 10 is supplied through the blade supporting metal plate 15, conductive paint 22 is electrically connecting the metal plate and the back electrode 21 and finally the back electrode 21.

Figure 3:
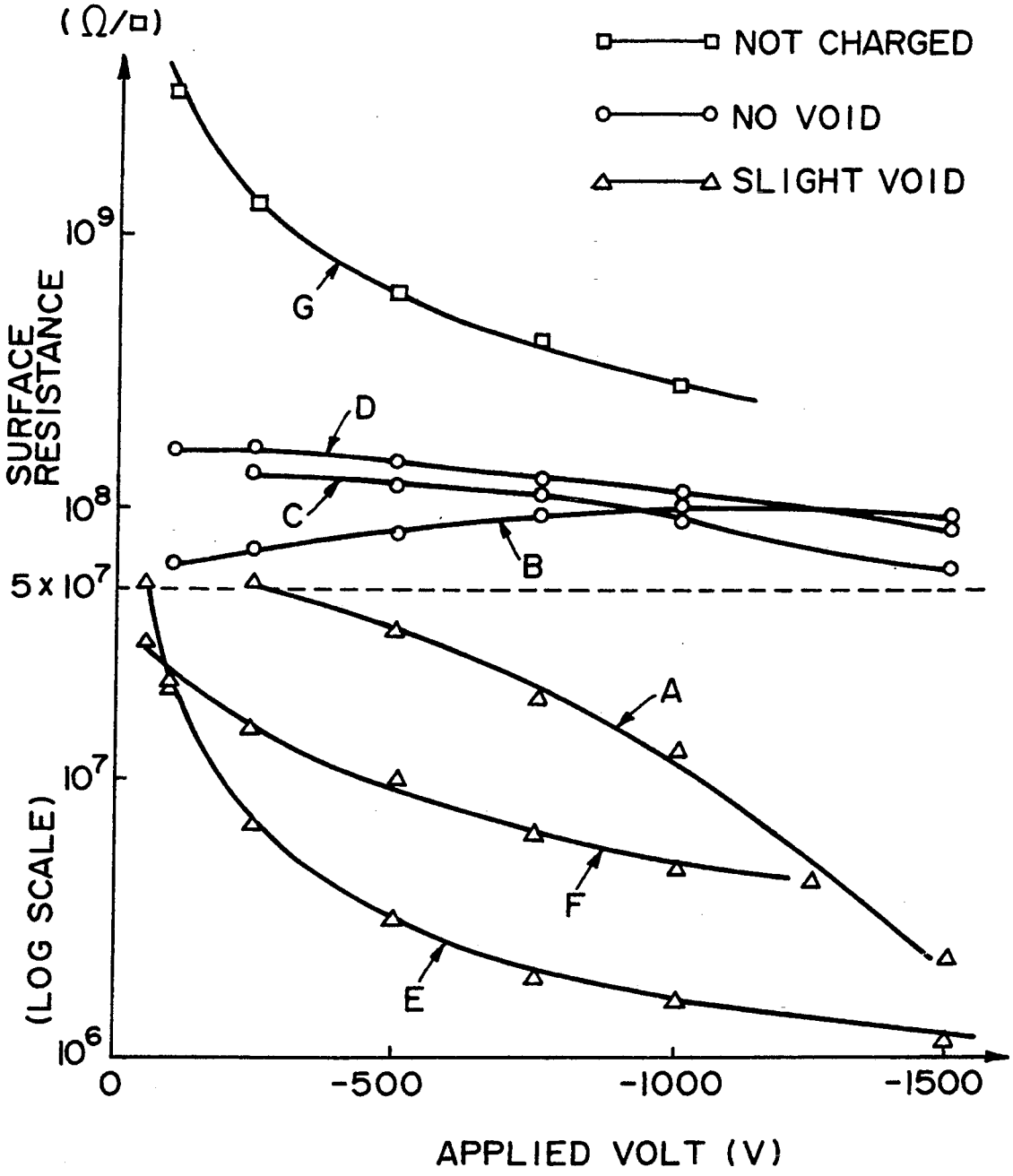
FIG. 3 is a graph of a relation between an applied voltage and a surface resistivity in various charging blades.
Figure 4:
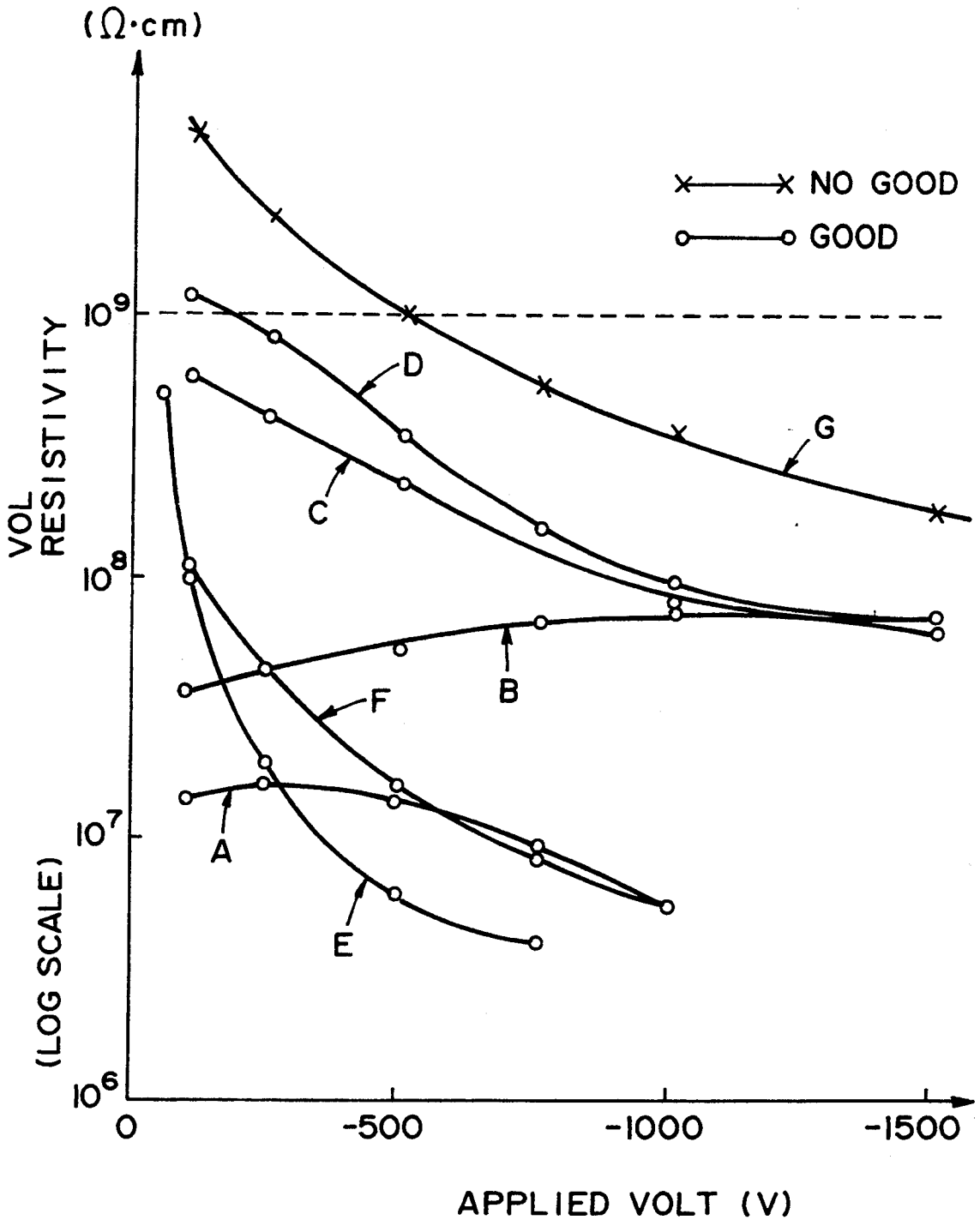
FIG. 4 also shows the relation between the applied voltage and the volume resistivity for the same charging blades.

(3) Experiments (FIGS. 3 and 4)

Using this embodiment, the following parameters were selected:

$\alpha = 35$ degrees $\theta = 10$ degrees

Thickness of the charging blade $= 1.5$ mm

Length of free part of the blade 10*l* $= 9.0$ mm various charging blades were prepared and are made of epichlorohydrin rubber or EPDM to which conductive powders such as carbon black, metal oxide (zinc oxide, titanium oxide or the like) or the like were added to provide various resistivities. The charging properties and local charge void were investigated. Charging blades A, B, C, D, E, F and G include charging blades A-D comprising as a base material epichlorohydrin rubber added with conductive powder, and blades E-G using EPDM added with conductive powder.

The charging properties and the local charge void have been evaluated after halftone images are formed, with the charging means disclosed in Japanese Laid-Open Patent Application No. 14966/1985 (contact type charging member).

Image Forming Conditions

Process speed: 72 mm/sec
Photosensitive drum diameter: 30 mm
Applied bias: AC+DC
AC: 500 Hz, 1800 Vpp
DC: −700 V
Pre-exposure: no
Potentials:
dark portion $V_D = -700$ V
light portion $V_L = -230$ V
halftone portion: $V_H = -400$ V Charging Properties This has been evaluated on the basis of whether the halftone image has the dots and sand like pattern in the background.

Local Charge Void

The photosensitive layer was peeled off (approximately 1 mm) to expose the aluminum base layer to deliberately provide the defective drum. If the resultant defect on the transferred image remains spot, no local charge is deemed to be produced. If it is enlarged to approximately 3 mm on the transferred image, the local charge void is deemed to exist slightly.

The evaluations of the blades A–G are as follows.

TABLE 1

| Blade No. | Charge | Void |
|---|---|---|
| A | Good | Slight |
| B | Good | No |
| C | Good | No |
| D | Good | No |
| E | Good | Slight |
| F | Good | No |
| G | No good | Unevaluatable |

The basic material of the charging blade A–D is epichlorohydrin rubber (that of the blades E–G is EPDM).

For the charging blades A–G , the surface and volume resistivities were measured with different voltages applied.

FIG. 3 shows the results of measurements (applied voltage vs. surface resistivity). FIG. 4 shows the results of measurement (applied voltage vs. volume resistivity). The voltage was applied by a constant high voltage source 1600 A RESISTIVITY CELL (available from Yokogawa-Hurret-Packard, Japan). The electric current 30 sec after the start of the voltage application, and the resistance is obtained from the current. The tested blade has a thickness of 1.5 mm (= t), and a size of 100 mm×100 mm. The measurements were carried out under 23° C. and 60% humidity.

The description will be made as to the graph of FIG. 3. The abscissa represents the applied voltage, and the ordinate represents the surface resistivity of the material tested.

The line including square marks represent the sample blade G. The results show that the charging is improper, and the local charge void could not be evaluated.

The line including round marks represents the tested blades B, C and D. The charging properties were good, and the local charge void was not produced.

The line including triangular marks represents the blade A, E and F tested. The local charge void slightly occurs.

It is considered that the local charge void occurs due to the movement of the electric charge on the charging blade. Then, if the surface resistivity is not more than a predetermined level, the local charge void does not occur. From FIG. 3, it is understood that the surface resistivity is not less than $5\times10^7$ ohm/□. As will be understood from FIG. 4, the surface resistivity is different depending on the voltage applied, and therefore, it is preferably not less than $5\times10^7$ ohm/□ even under the applied voltage not less than 500 V.

The description will be made as to the graph of FIG. 4. The abscissa represents the applied voltage, and the ordinate represents the volume resistivity of the blade. The line including "x" marks represents the sample G. The proper charging operation was not possible.

The line including circular marks represents the blade A–F. The charging properties were good.

It is considered that the voltage drop through the charging blade depends on thee volume resistivity of the charging blade. Then, the voltage drop increases with the surface potential of the charging area of the charging blade. If the surface potential is low, the electric field between the surface of the charging blade and the surface of the photosensitive drum is weak, and therefore, the uniformizing effect of the AC electric field is not sufficient to provide the stabilized charging, which leads the improper charging.

Therefore, the improper charging does not occur if the volume resistivity of the charging blade is not more than a certain level. FIG. 4 shows that the proper charging properties can be provided if it is not higher than $1\times10^9$ ohm.cm.

Similarly to the surface resistivity, the volume resistivity is different depending on the applied voltage. Therefore, it is preferably not more than $1\times10^9$ ohm.cm under the application of 100 V.

As described in the foregoing, the local charge void can be prevented by selecting the surface resistivity to be not less than $5\times10^7$ ohm/□. The charging property is good if the volume resistivity of the charging blade is not more than $1\times10^9$ ohm.cm. If both of the requirements are satisfied, the local charge void can be prevented, and the good charging properties can be maintained in a single layer structure of the blade.

The surface resistivity described above is the minimum level when the leakage does not occur. The volume resistivity discussed above is the maximum to provide the good charging property. Accordingly, the upper limit of the surface resistivity and the lower limit of the volume resistivity are property determined by one skilled in the art on the basis of the ambient conditions.

The above requirements are not limited to the charging using the alternating electric field, but applies to the charging using a DC electric field.

Figure 5:
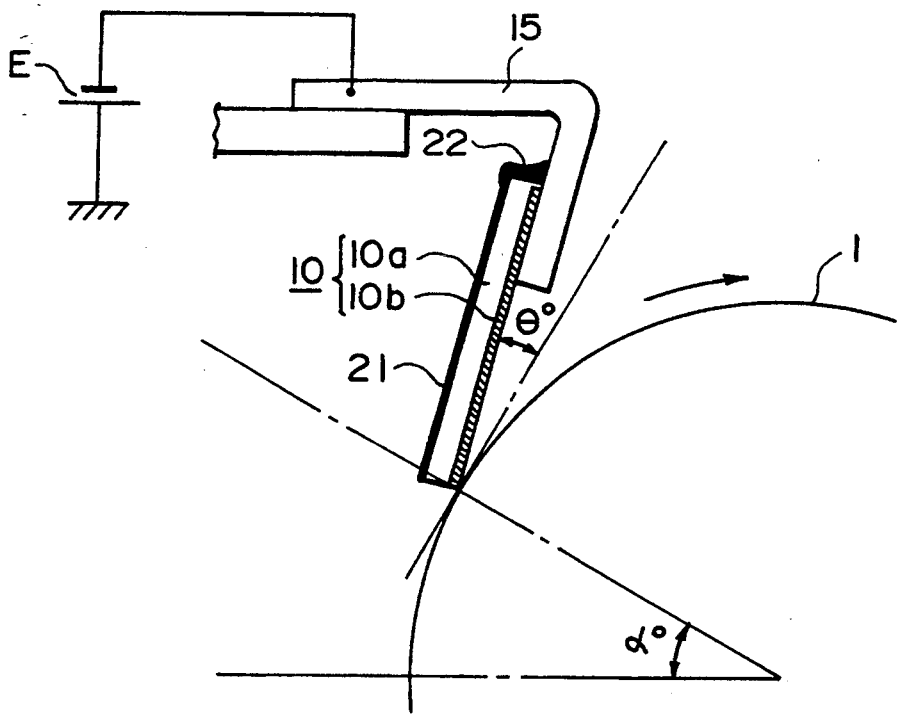
FIG. 5 is an enlarged view of the charging blade of a two layer type.
Figure 6:
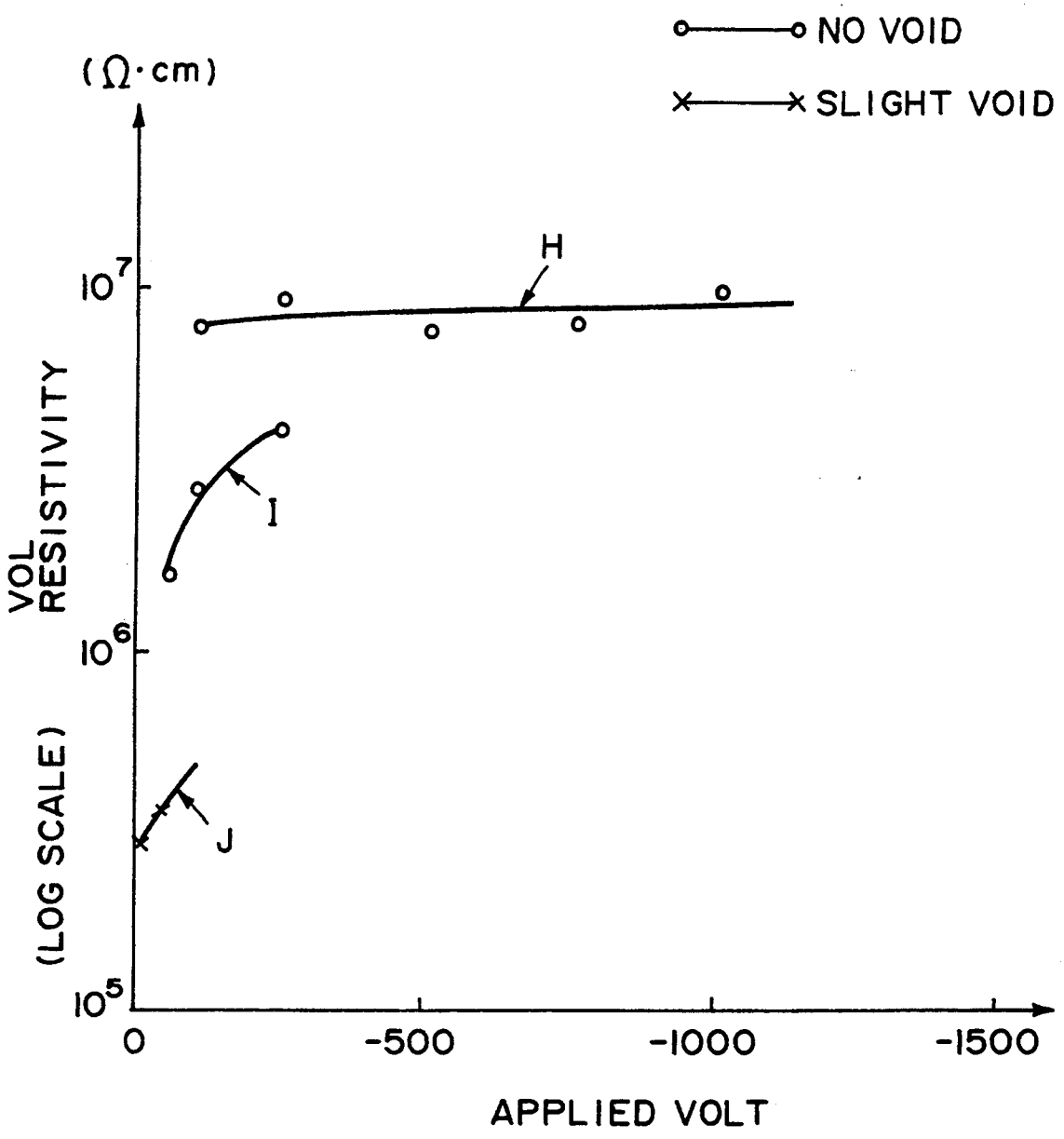
FIG. 6 is a graph showing a relation between an applied voltage and a volume resistivity of the two layer type charging blades.

Embodiment 2 (FIGS. 5 and 6)

The charging blade 10 of this embodiment is of a two layered structure having an intermediate resistance base layer 10*a* and a coating layer 10*b*.

The charging blade 10 is fixed on a blade supporting metal plate 15. To the metal plate, a required voltage is applied by an unshown bias voltage from an unshown bias voltage source. The voltage is applied to the back electrode 21 through the conductive paint 22. The voltage applied to the back electrode 21 forms an electric field sufficient to effect the charging in the small clearance between the photosensitive drum 1 (the member to be charged) and the charging blade 10, through the intermediate resistance layer 10*a* and the coating layer 10*b* of the charging blade 10.

The detailed description will be made as to the two layers 10*a* and 10*b* constituting the charging blade 10.

As for the intermediate resistance layer 10*a*, the rubber material described in connection with the first embodiment is usable, and the thickness thereof is 1–3 mm.

The material of the coating layer 10*b* has a surface resistance which is not less than $5\times10^7$ ohm/□, and the thickness thereof is 3–100 microns. If it is smaller than 5 microns, an unavoidable non-uniformity of the coating, would result in production of the portion which is hardly coated. From the standpoint of the stability of the coating, the thickness of the coating layer is preferably not less than 10 microns in consideration of the non-uniformity.

The material of the coating layer 10*b* preferably has flexibility, good surface properties, a low frictional coefficient and wear resistance.

A soft elastic lubricating layer 10*b*, for example, comprises soft elastic material (urethane resin, polyurethane elastomer or the like) in which flourinated resin material (PTFE, PFA or the like) powder and resistance controlling conductive powder (carbon black, zinc oxide, titanium oxide or another metal oxide) are dispersed, so that the layer 10*b* has the surface resistance of $5\times10^7$ ohm/□.

The flourinated resin to,be dispersed is preferably PTFE from the standpoint of decreasing the friction coefficient. The particle size of the powder is preferably 0.1–several microns. The amount of dispersion is preferably 10 or more, further preferably 15–40 parts by weight.

The content of the conductive powder for the purpose of resistance control is dependent on the resistance, material and particle size of the conductive powder, but if it is carbon, 3–5 parts by weight is preferable, and if it is zinc oxide, 6–10 parts by weight is preferable.

The intermediate resistance base layer 10*a* and the soft elastic lubricant layer 10*b* are completely bonded. Even if the two layered blade is bent, the two layers are firmly bonded without peeling therebetween.

The surface roughness of the soft elastic lubricating layer 10*b* is not more than 2 microns (Rz), and the dynamic friction coefficient is not more than 0.1. The reason why the frictional coefficient is low, is that the PTFE particles are exposed on the lubricating layer 10*b*, that the PTFE particles provide fine surface roughness with the result of reduction of the practical contact areas.

The blade 10 is contacted to the OPC photosensitive member 1 with the contact pressure of 10–15 g/cm, and an AC+DC voltage is applied to effect the charging operation, for a long period of time. The photosensitive member is hardly damaged even after $3\times10^3$ are processed. It has been confirmed that good images are provided.

Even under the high temperature and high humidity conditions, the blade is not folded back, and good results were provided.

The soft elastic lubricant layer 10*b* functions as a protection layer for preventing the oil from woozing from the intermediate resistance layer 10*a* to the photosensitive member 1.

The durability tests has been carried out with a single layer blade only having the intermediate resistance layer 10*a* without the soft elastic lubricating layer 10*b*. Under the high temperature and high humidity conditions, the blade edge is folded back after several tens sheets were processed. Even under the normal temperature and normal humidity conditions, the surface of the photosensitive member is damaged after 500 sheets were processed, with the result of stripes in the image.

In this embodiment, carbon is dispersed in PTFE dispersed paint (Emlaron 345, available from Achison Kabushiki Kaisha) to provide the surface resistivity of $1.7\times10^8$ ohm/□ (when 1.0 KV is applied). It is applied by dipping onto the blade B with the coating thickness of 30 microns.

The coating layer 10*b* has a very low frictional coefficient as compared with the epichlorohydrin rubber of the base layer 10*a*, and therefore, the sliding property is remarkably improved. Therefore, the blade is prevented from folding back at the initial stage of the photosensitive drum 1 rotation. In addition, the torque added by the pressure-contact with the blade can be reduced, and therefore, the reduction of the drum damage during a long term use is expected.

When, for example, the photosensitive member is of polycarbonated resin, the dynamic friction coefficient of the coating layer 10*b* was 0.1–0.2, whereas the dynamic frictional coefficient of the epichlorohydrin rubber 10*a* was 1.0 or more, The two layer structure is advantageous because it can provide the blade with the advantages such as low frictional coefficient or the like.

If the requirement that the volume resistivity is not more than $1\times10^9$ ohm.cm, the base layer 10*a* may be in the form of a film. The film is advantageous from the standpoint that the contact pressure with the photosensitive drum can be reduced with the advantage of the less possibility of the damage of the photosensitive drum. As compared with the case of rubber material for the layer 10*a*, the sufficiently small contact pressure can be realized even if the free length (l in FIG. 2) is small. Therefore, the required space is reduced.

The epichlorohydrin rubber of the base layer 10*a* used in this embodiment is such that the oil in the rubber, although the amount is small, is transferred onto the photosensitive drum 1 to contaminate it, if it is kept in direct contact with the photosensitive drum 1 for a long period of time. From the standpoint of preventing the drum contamination, the coating layer 10*b* is effective.

Among the charging blades discussed with the first embodiment, only the blades B, C and D satisfy the proper charging property and sufficient local charge void prevention. Referring to FIG. 4, the volume resistivities of the blades B, C and D are within the range of $5\times10^7$–$1\times10^9$ ohm.cm. Generally, there is a high correlation between the surface resistivity and the volume resistivity, and therefore, the resistance of the material is limited to a very small range, under the condition of the surface resistivity of $5\times10^7$ ohm/□ or higher and the volume resistivity of $1\times10^9$ ohm.cm or lower. Therefore, in consideration of the variation in the resistance control and the variation in the manufacturing, the selection is difficult.

However, if the charging blade 10 is of two layered structure (10*a*, 10*b*), and if the thickness of the coating layer 10*b* (the layer contacting to the photosensitive drum 1) is 1/10–1/50 of the thickness of the intermediate resistance layer 10*a*, then, the controllable range of the resistance of the layers 10*a* and 10*b* is increased.

The volume resistivity influential to the charging property is dependent on the resistance of the charging blade if the thickness is constant. If, the thickness of the coating layer 10b is 1/10–1/50, for example, the resistance is equivalent even if the material has the volume resistivity which is 10–50 times. Therefore, even if the resistance of the base layer 10a is doubled, the volume resistivity of the coating layer 10b may have a volume resistivity higher than by one order, so that the selection or control of the resistance of the coating layer 10b is assured to be not less than $5\times10^7$ the intermediate resistance base layer 10a is not required to increase the volume resistivity in order to satisfy the requirements for the surface resistance of $5\times10^7$ ohm.cm or higher. Therefore, the material having the lower volume resistivity is usable.

Figure 7:
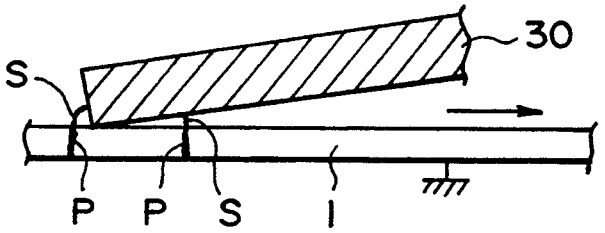
FIG. 7 is a sectional view illustrating the occurrence of local charge void.
Figure 8:
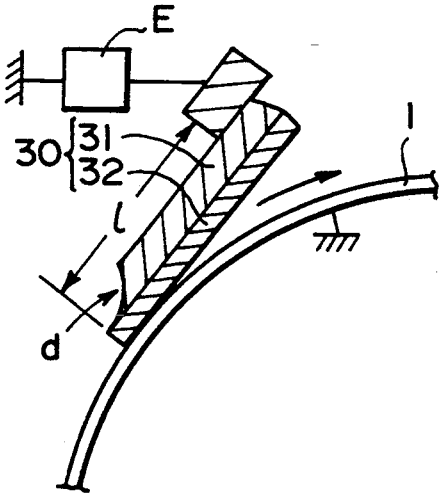
FIG. 8 is a sectional view of a charging blade having an end surface not coated.

However, the lower limit of the volume resistivity is limited by the requirement for the prevention of the leakage (FIG. 7) at the blade edge.

In consideration of the above, the surfaces of the charging blade of the first embodiment (blades H, I and J (intermediate resistance base layer)) are coated with a coating layer 10b of 30 microns comprising the PTFE dispersed paint in which the carbon particles are dispersed to provide the surface resistivity of $1.7\times10^8$ ohm/□ (1.0 KV voltage application). The blade is cut CUT. The cut surface is exposed as it is (FIG. 5). The image formations were performed, and the degree of the local charge void is inspected.

FIG. 6 are graphs of the applied voltage vs. volume resistivity of the three blades H, I and J.

It is understood from FIG. 6 that the local charge void does not occur in the blades H and I. The edge leakage is not observed. In the case of the blade J, the local charge void is observed, that is, the leakage occurs at the edge end surface.

From the foregoing, the volume resistivity of $1\times10^6$ ohm.cm or higher is required for the intermediate resistance base layer 10a to prevent the edge end surface leakage.

Thus, the selectable range of the volume resistivity of the coating layer 10b expands up to $1\times10^9$ ohm.cm which is higher by one order than $1\times10^8$ ohm.cm. The intermediate resistance layer 10a is selectable in the range of $1\times10^6$ ohm.cm–$1\times10^9$ ohm.cm. Therefore, the selectable ranges for the respective layers 10a and 10b are expanded to facilitate manufacturing of the charging blade.

In FIG. 5, the coating layer 10b is applied to the entire contacting surface, or it is applied to the charging region closely adjacent to the contact portion, by which the intended functions are sufficiently provided.

The material of the coating layer 10b is not limited to the PTFE dispersed paint, but may be a resistance controlled nylon, polyurethane elastomer or the like.

As described in the foregoing, according to the present invention, the contact type charging member has a simple structure and can be produced stably at low cost with a smaller number of manufacturing steps. In addition, the charging properties are good, and the local charge void can be sufficiently prevented.

While the invention has been described with reference to the structures disclosed herein, it is not confined to the details set forth and this application is intended to cover such modifications or changes as may come within the purposes of the improvements or the scope of the following claims.

What is claimed is:

1. A charging device for charging a moving member to be charged, comprising:

a charging member for contact with the member to be charged, wherein said charging member extends in a direction along a generating line of said member to be charged and has a first layer contactable to the member to be charged and a second layer disposed further from the member to be charged than the first layer; and means for applying a voltage to said charging member;

wherein said first layer has a surface resistivity at a surface contactable to the member to be charged not less than $5\times10^7$ ohm/square, and said second layer has a volume resistivity of not more than $1\times10^9$ ohm.cm.

2. A device according to claim 1, wherein said voltage is a superposed voltage of a DC voltage and an AC voltage.

3. A device according to claim 1, wherein said voltage is a DC voltage.

4. A device according to claim 1, wherein said charging member is in the form of a blade.

5. A charging device according to claim 4, wherein said charging member is counter-directionally contactable to the member to be charged.

6. A charging device according to claim 5, wherein an angle formed between said charging member and said member downstream of the member to be charged with respect to movement direction thereof is not more than 30 degrees.

7. A device according to claim 1, wherein said second layer includes rubber material.

8. A device according to claim 7, wherein the rubber material includes epichlorohydrin rubber.

9. A device according to claim 1, wherein the member to be charged is an image bearing member.

10. A device according to claim 9, wherein said image bearing member is a rotatable photosensitive drum.

11. A device according to claim 10, wherein said charging member extends along an axis of said photosensitive drum.

12. A device according to claim 1, 7 or 8, wherein said charging member is in the form of a blade and said first and second layers have thicknesses of 1–3 mm.

13. A device according to claim 1, wherein the first layer is a PTFE dispersed paint.

14. A charging device according to claim 13, wherein said first layer contactable to said member to be charged has a surface roughness of not more than 2 microns.

15. A device according to claim 13, wherein a dynamic friction coefficient between the member to be charged and the first layer is not more than 0.1.

16. A device according to claim 1, wherein the first layer has a thickness of 3–100 microns, and the second layer has a thickness of 1–3 mm.

17. A device according to claim 1, 7 or 8, wherein the first layer is of nylon resin.

18. A device according to claim 1, 7 or 8, wherein the first layer is of polyurethane elastomer material.

19. A device according to claim 1, 7 or 8, wherein fluorine resin is dispersed in the first layer.

20. A device according to claim 1, wherein said second layer has a volume resistivity of not less than $1\times10^6$ ohm.cm.

21. A device according to claim 1, wherein said first layer has a thickness of 1/10–1/50 of the thickness of said second layer.

22. A charging device according to claim 1, wherein said first layer contactable to said member to be charged has a surface roughness of not more than 2 microns.

23. A device according to claim 1, wherein a dynamic friction coefficient between the member to be charged and the first layer is not more than 0.1.

24. A device according to claim 1 or 16, wherein the first layer has a thickness of not less than 10 microns.

25. A charging device according to claim 1, wherein fluorine resin powder is disposed within said first layer.

26. A charging device for charging a moving member to be charged, comprising:

a charging member for contact with the member to be charged, said charging member extending in a direction along a generating line of said member to be charged and having a first layer contactable to the member to be charged;

means for applying a voltage to said charging member;

wherein said contactable layer has a volume resistivity of not more than $1\times10^9$ ohm.cm and a surface resistivity of not less than $5\times10^7$ ohm/square.

27. A device according to claim 26, wherein said voltage is a superposed voltage of a DC voltage and an AC voltage.

28. A device according to claim 26, wherein said charging member is in the form of a blade.

29. A device according to claim 26, wherein said contactable layer includes rubber material.

30. A device according to claim 29, wherein the rubber material includes epichlorohydrin rubber.

31. A device according to claim 26, wherein said charging member is contactable to the member to be charged counter-directionally with respect to a movement direction thereof.

32. A charging device according to claim 31, wherein an angle formed between said charging member and said member downstream of the member to be charged with respect to movement direction thereof is not more than 30 degrees.

33. An image forming apparatus, comprising:

a movable image bearing member;

a charging member contactable to said image bearing member to electrically charge it, said charging member extending in a direction along a generating line of said image bearing member and having a first layer contactable to said image bearing member and a second layer disposed further from the image bearing member than the first layer;

a voltage application means for applying a voltage to said charging member;

wherein said first layer has a surface resistivity at a surface contactable to the member to be charged not less than $5\times10^7$ ohm/square, and said second layer has a volume resistivity of not more than $1\times10^9$ ohm.cm.

34. A process cartridge detachably mountable to an image forming apparatus, comprising:

a movable image bearing member;

a charging member contactable to said image bearing member to electrically charge it, said image bearing member extending in a direction of a generating line of said image bearing member and having a first layer contactable to said image bearing member and a second layer disposed further from the image bearing member than the first layer;

wherein said first layer has a surface resistivity at a surface contactable to the member to be charged not less than $5\times10^7$ ohm/square, and said second layer has a volume resistivity of not more than $1\times10^9$ ohm.cm.

35. An image forming apparatus, comprising:

a movable image bearing member;

a charging member contactable to said image bearing member to electrically charge it, said charging member extending in a direction of a generating line of said image bearing member and having a first layer contactable to said image bearing member;

a voltage application means for applying a voltage to said charging member;

wherein said contactable layer has a volume resistivity of not more than $1\times10^9$ ohm.cm and a surface resistivity of not less than $5\times10^7$ ohm/square.

36. A process cartridge detachably mountable to an image forming apparatus, comprising:

a movable image bearing member;

a charging member contactable to said image bearing member to electrically charge it, said charging member extending in a direction of a generating line of said image bearing member and having a first layer contactable to said image bearing member;

wherein said contactable layer has a volume resistivity of not more than $1\times10^9$ ohm.cm and a surface resistivity of not less than $5\times10^7$ ohm/square.

* * * * *